United States Patent [19]

Smalley

[11] Patent Number: 4,821,898

[45] Date of Patent: Apr. 18, 1989

[54] CHILD RESISTANT HINGE TOP CLOSURE

[75] Inventor: Ned J. Smalley, Perrysburg, Ohio

[73] Assignee: Owens-Illinois Closure Inc., Toledo, Ohio

[21] Appl. No.: 206,163

[22] Filed: Jun. 10, 1988

[51] Int. Cl.[4] ..... B65D 55/02

[52] U.S. Cl. ..... 215/216; 215/211; 215/206; 215/237; 215/253

[58] Field of Search ..... 215/206, 216, 253, 237, 215/235, 211; 220/260; 222/153

[56] References Cited

U.S. PATENT DOCUMENTS

| | | | |
|---|---|---|---|
| 4,723,669 | 2/1988 | Barriac | 215/206 |
| 4,752,013 | 6/1988 | Miller et al. | 215/253 |
| 4,759,455 | 7/1988 | Wilson | 215/206 |
| 4,782,964 | 11/1988 | Poore et al. | 215/216 |

*Primary Examiner*—George T. Hall

[57] ABSTRACT

A hinged dispensing closure of unitary molded construction is disclosed which may be readily opened by an adult using one hand. A narrow slot of short length is molded near the periphery of the top wall of the snap-hinged cover cap opposite its hinged connection to the main closure. The sidewall of the cover cap includes axially extending parallel score lines from near its skirt edge to the ends of the slot to define a tab. Pressing by the thumb on the tab while holding the package in the same hand ruptures the scores and deflects the tab inwardly for ready access to an exposed edge of the formed slot; and pressure on the edge opens the cover cap. The deflected tab is held by an internal cam wall inwardly of the slot, which indicates that the package is opened when the tab is held in this deflected position. A second embodiment provides a hook and latch locking means between the main closure and cover cap opposite the hinge. This lock may be disengaged by the thumb for unlatching the cover cap by depressing its skirt wall at the hook and latch location and opening the cover cap with one hand. The main closure is threaded on the container. The main closure and container are provided with cooperating ratchet teeth to render the closure on the container a safety closure against accidental removal by children.

24 Claims, 4 Drawing Sheets

CHILD RESISTANT HINGE TOP CLOSURE

FIELD OF THE INVENTION

The invention relates to child resistant, tamper indicating closures for containers, and more particularly to hinge top closures of the dispensing type in which a main closure is installed on a container and includes a hinged cover cap which is manipulated about the hinge connection to the main closure to open or closed position for dispensing product from the container through the closure.

BACKGROUND OF THE INVENTION

Known plastic dispensing closures include a closure body that is secured to the neck of a container by threading the body onto the neck finish threads of the container. A cover cap is molded with the body and attached by a snap hinge such that the cap is pivoted between an open position for discharging product from the container and a closed position closing the discharge outlet. The hinge is integrally molded from the polymeric plastic of the closure and cap and enables the cap to be pivoted relative to the closure by simple hand manipulation of the user. Typical snap-hinged dispensing closures are disclosed in U.S. Pat. Nos. 4,638,916, 4,625,898 and 4,487,324.

Prior art closures using a cover cap have incorporated various locking flap features to render them child resistant. An example is disclosed by U.S. Pat. No. 4,209,100. Other dispensing closures, such as disclosed in U.S. Pat. No. 4,595,123, provide means on the main closure attaching it to the container threads to render it non-removable, and, thus provide child resistant, safety closures.

Presently, child resistant packages require at least two different manual manipulations by the user to open them; such as a simultaneous push and turn manipulation with one hand holding the container and the other hand pushing down on the closure while turning it in the unscrewing direction. Others require holding the container in one hand while the other hand lifts a part of the closure and simultaneously unscrews the closure from the container. Still others require holding the container in one hand and with the other hand squeezing the skirt from opposite sides and simultaneously unscrewing it from the container. In general, these manipulations require the use of both hands to open the package.

SUMMARY OF THE INVENTION

One of the principal objects of this invention is to provide a child resistant, tamper indicating closure which can be opened with relative ease by an adult. The invention allows the package to be opened using only one hand. The wall of the top cap on the closure is provided with a molded slot at the periphery of the top wall, and axial scores in the sidewall defining a tab may be readily depressed inwardly at or near the juncture of the skirt and top walls using the thumb of one hand to deflect this closure wall area while holding the container in that hand. Once the wall area is deflected, a lifting ledge is provided to push upwardly by the thumb and lift the cap off the retaining or locking means thereby opening the package for use.

In the preferred form, the invention is incorporated into a hinged dispensing closure by molding a narrow slot of short length at the outer periphery of the cover cap opposite the hinged connection of the cap with the main closure that is secured on the container. At the opposite ends of the slot are axially extending lines of weakening along the side wall of the cover cap which together define a tab portion. Depressing the wall adjacent and below the slotted area deflects the tab portion inwardly exposing a leverage point to lift the cap by the thumb to release the lock means normally holding the cap closed.

There are also ratchets formed on the inside skirt wall of the main closure below the threads. Corresponding ratchet projections are formed on the container below its threaded finish. This provides a second lock means securing the main closure on the container against unscrewing and removing it. The ratchets when engaged after screwing the main closure on the container lock the closure against easy removal from the container and provide the child resistance feature of the entire package.

Another object of the invention is to provide the child resistant closure including the one hand operational design that is lightweight and easily molded by existing technique and molding equipment, and is, therefore, economical to manufacture.

Included in the construction of the invention is a means for locking the cover cap in a closed position on the container. Preferably, in the hinged cover dispensing cap, the lock means incorporates a snap ring bead on the cover cap interengaging the spout of the dispensing main closure when the cover cap is closed. The main closure also includes a radial shoulder or ledge that seats the free bottom edge of cover cap skirt when closed such that a lifting surface or edge at the skirt is not accessible. The only access to lift the cover cap is, therefore, by depressing the cover cap wall to deflect the tab and create a surface for lifting the cover cap and releasing the lock means for opening the package. After the tab is deflected and broken free along the side wall, the package now has an indication that it has been opened, thereby providing a tamper indicating feature.

The invention has as a further object to provide a child resistant, tamper indicating closure which is safe against opening by small children, yet is readily operable for opening by adults, including senior citizens, who may otherwise be limited in dexterity in their hands.

For a further understanding of the invention and the objects thereof, reference is made to the drawings and the description thereof, to the detailed description of the invention, and to the appended claims.

DETAILED DESCRIPTION OF THE INVENTION

Figure 1:
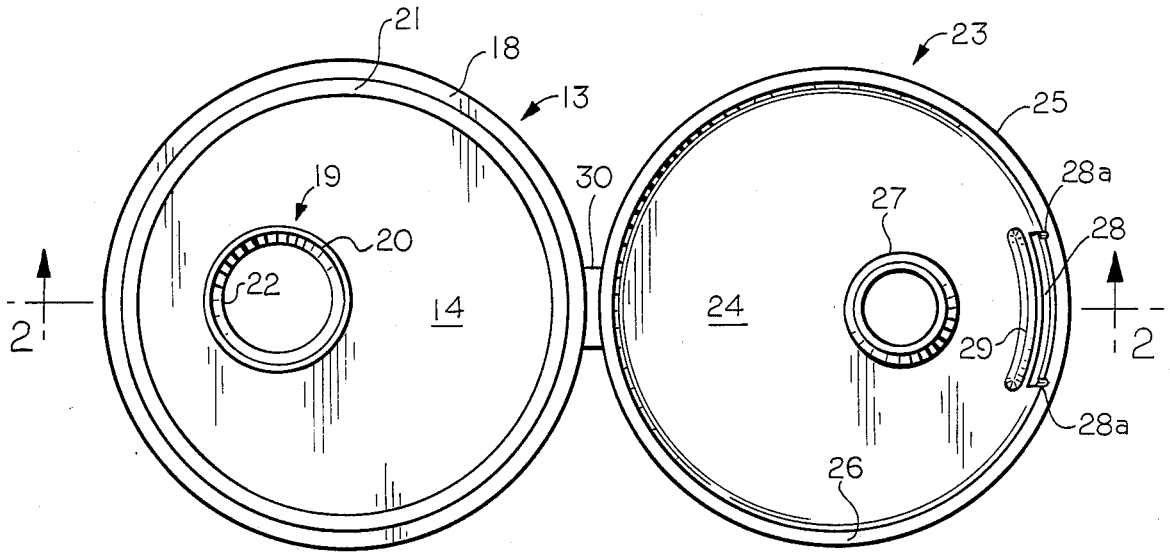
FIG. 1 is a top plan view of a dispensing closure incorporating the present invention, and showing the cover cap in open position.

As is shown in FIGS. 1–5, a dispensing closure in accordance with the present invention, indicated generally by reference numeral 11, is threaded shown on the neck 12 of a container. Closure 11 is molded of a plastic material, such as polypropylene, and comprises a main closure 13 comprised of a top wall 14 and downwardly depending annular skirt 15. Internal threads 16 are molded on the skirt 15, which are engaged with corresponding threads 17 on the exterior of the circular neck 12 of the container. The skirt 15 and top wall 14 of the closure body are joined and provide an annular radial ledge 18 that is defined in its inward extent by the annular ridge 21. A tubular spout 19 extends from the exterior of the top wall 14 and terminates at a circular rim 20 that includes a chamfer and interior bead 22. The rim 20 defines a dispensing orifice connected to the interior of the container through the spout 19.

A cover cap 23 is molded integrally with body 13 and includes a top wall 24 joined to peripheral skirt 25 at a corner radius **25*a*. The shoulder 18 is engageable with the free edge 26 of skirt 25 when the cover cap is in a closed position. A circular wall 27 depends downwardly from the inner surface of top wall 24 defining a hollow plug that is adapted to fit inside spout 19. The cap 23 swings into and out of closed position on spout 19. The chamfered rim 20 guides wall 27 by its chamfer surface 27*a* into the opening of spout 19. The rib 22 provides a friction fit for inner wall 27 to insure a good seal for contents of the container, e.g. a liquid, and wall 37 cleans the spout of material poured through the orifice in the rim area. The friction fit of rib 22 and the wall surface 27** also provides a locking means securing the cover cap on the closure body in a closed position.

Figure 2:
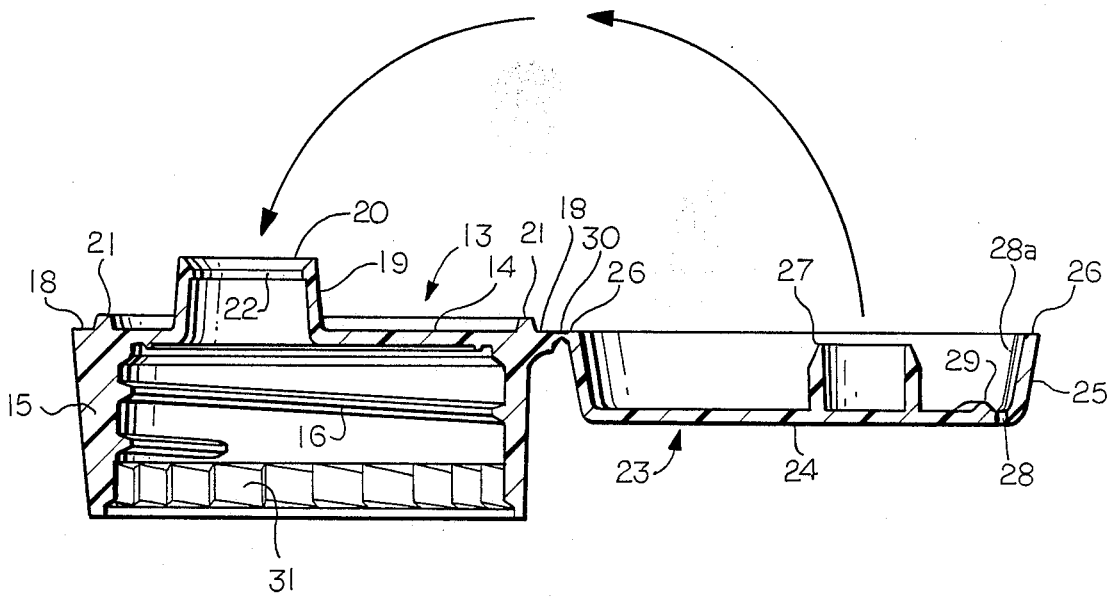
FIG. 2 is a sectional elevational view of the dispensing main closure body and cover cap taken along line 2—2 on FIG. 1.

The radial ledge 18 on the top periphery of the main closure 13 corresponds with and underlies the free edge 26 of the cover cap skirt 25. An integral hinge 30 has its upper surface in the plane of radial ledge 18 of the closure body and the free edge 26 of the skirt of the cover cap. The hinge action is about the thin central section along the span of hinge 30 (FIG. 2). Hinge straps may be provided (not shown) between the perimeter surface of skirt 15 of the main body and the skirt of the cover cap. The straps, if proportioned so they stretch in operation during both opening and closing the cover cap on the main closure, provide a snap hinge action with the characteristics of a "live hinge" for the closure's cap. This snap hinge construction is more fully shown and described in U.S. Pat. No. 4,638,916. The cover cap 23 when closed, as shown on FIG. 3, fits the edge 26 of the cover cap skirt in annular abutment with the radial ledge 18 of the main closure. The interengagement of the wall 27 and bead 22 on the spout and hollow plug, respectively, frictionally hold the cover cap closed on the main closure.

The tamper indicating opening means of the invention comprises a curved slot 28 molded over a short distance in the region of radius **25*a* at the juncture between the top wall 24 and the skirt 25 of the cover cap 23. The slot follows the circular contour of the corner radius of the cap directly opposite hinge 30, for but a short span, on the order of three-quarters inch to one inch in length. The slot 28 is narrow, i.e. molded as approximately 1/32 inch wide. From the end extremities of slot 28 to near the edge 26 of the skirt, there are two score lines 28*a* which are axially extending through the skirt and approximately parallel each other. The score lines 28*a* are molded on the inside surface of cap 23 so that they are virtually invisible and the lines 28*a* provide a weakened line in the skirt 25 and radius 25*a* that will together with slot 28 define an upright tab portion T of the cap skirt which may be readily ruptured and deflected inwardly by manual pressure P of the user's thumb. Some indicia (see arrow on FIG. 4) will advise the user of the pressure point to rupture and deflect the tab T. As is illustrated, it is preferable the axial score lines 28*a* run short of the lower edge 26 of the cap skirt to provide a hinge connection 28*c* for the lower end of tab T on the skirt 25. This hinge 28*c* is illustrated on FIG. 5. As is shown on FIG. 3, the ring 21 also serves as a fulcrum to assist in deflecting tab T portion of skirt wall 25 assuring that the edge surface at slot 28** will be exposed, that is, the maximum deflection of the skirt wall will occur at this most remote point from the lower fulcrum on the edge of the skirt.

Upon rupture of the tab portion T along its sides, continued pressure P deflects the top arcuate end **28*b* of the tab inwardly and past the arcuate stub wall 29 located at the under surface of top wall 24 near the corner radius 25*a*. The outer radial surface of stub wall 29 is curved as a camming surface to allow the curved end portion 28*b* of tab T to ride under and past wall 29. The radial back side of wall 29 is somewhat more abrupt in pitch and retains the tab T from returning to the original position along the peripheral arcuate plane of the rest of skirt 25**. The retained, inwardly deflected position of the tab T provides a clear visual tamper indicating device on the package.

Figure 3:
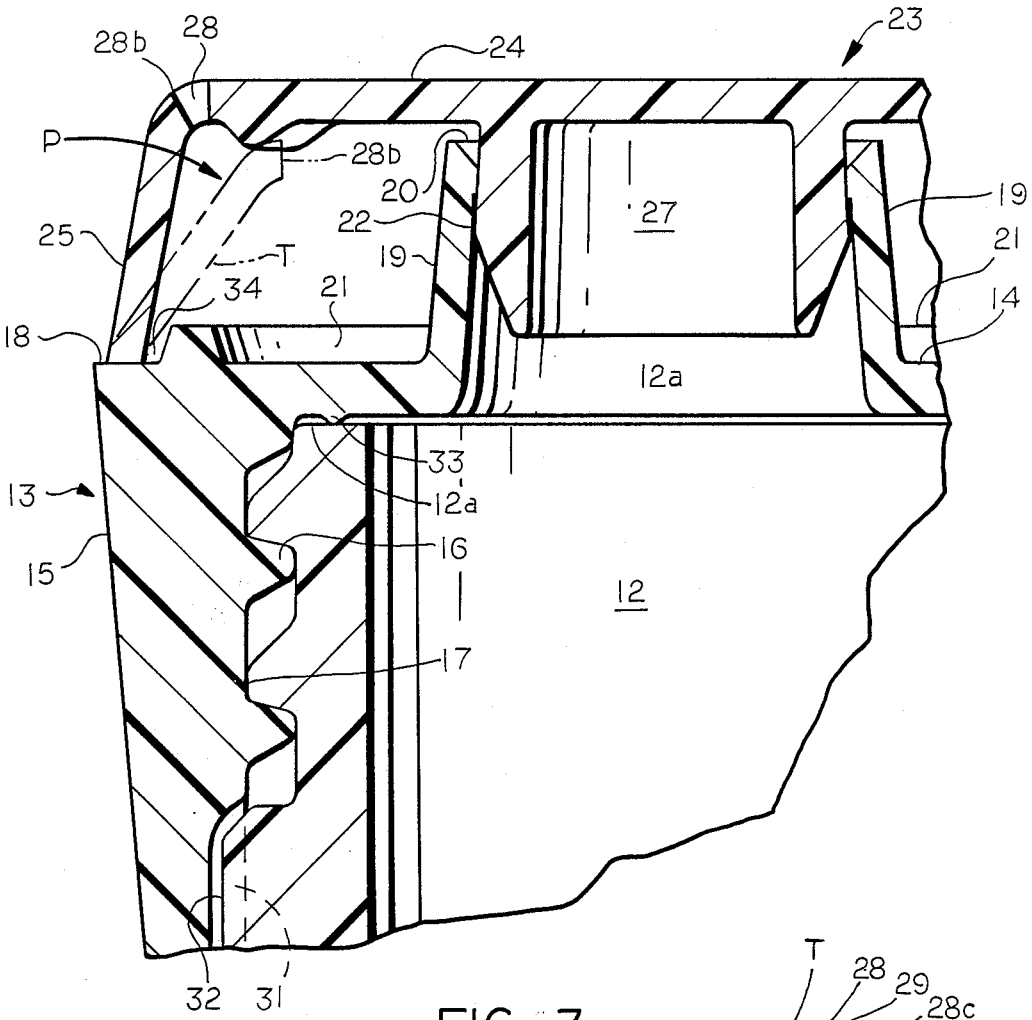
FIG. 3 is an enlarged fragmentary elevational view of the dispensing closure of FIG. 2 mounted on the neck of a container showing the cover cap closed on the main closure.
Figure 4:
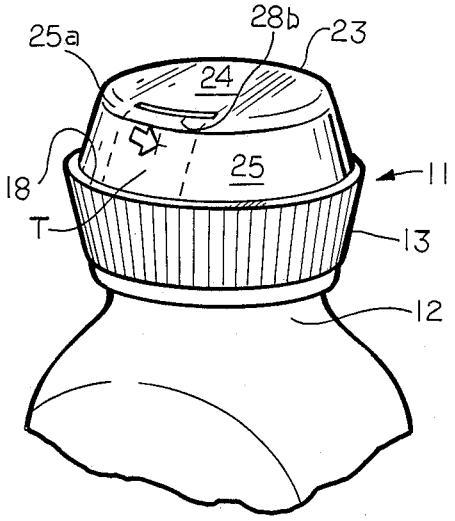
FIG. 4 is a three-quarter front prospective view of the dispensing closure of FIG. 2 showing it secured on a container as it appears prior to first opening of the package.
Figure 5:
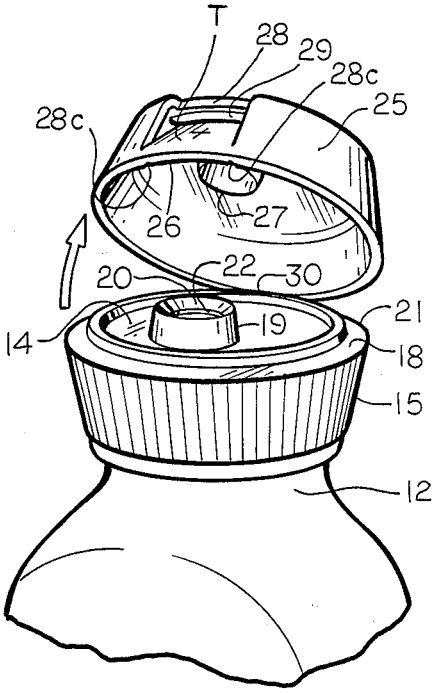
FIG. 5 is a three-quarter front prospective view like FIG. 4 in which the top cap is being pivoted to open position.
Figure 6:
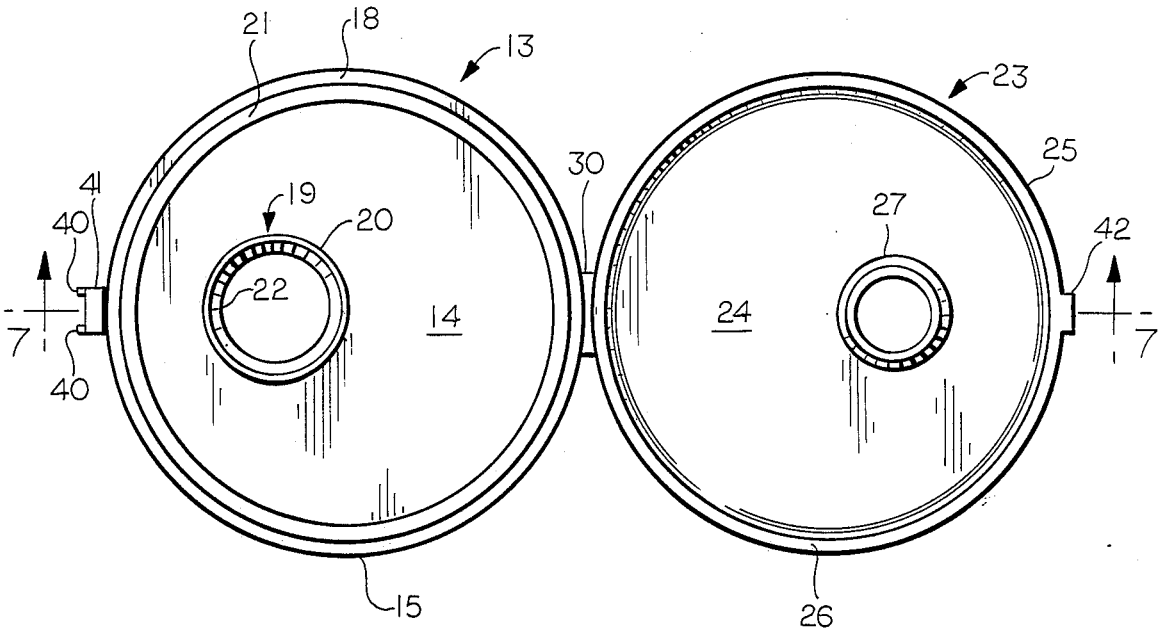
FIG. 6 is a top plan view of a second embodiment of the invention showing the cover cap in open position.

As is shown on FIGS. 2 and 3, the main closure 13 is made child resistant by the ratchet teeth 31 at the lower region of the skirt 15 below threads 16. The ratchets of the closure will mesh with similar and corresponding ratchet teeth 32 located below the threads 17 of the container. In practice, main closure 13 is screwed on the threads of the container until the annular seal ring 33 seats on the top of the rim **12*a*. The ratchet teeth 31 are sloped in the direction for applying the closure and ride over the complementary ratchet teeth 32 of the container. When the main closure is fully applied, rotation in the opposite direction for removing it from the container is prevented by the radial surfaces of the respective ratchet teeth engaging thereby locking the closure against further rotation for removal from the container. The ring 21 on the top wall 14 of main closure 13 prevents prying or biting the lower free edge of skirt 25. The ring backs up the skirt around its peripheral extent to prevent inwardly deflecting it at the level of its lower free edge. By this construction, ring 21 prevents pushing the skirt inwardly for prying it off from its lower edge. Inwardly of slot 28, the arcuate stub wall 29 formed along the extent of the length of slot 28 reinforces the top wall 24 to make it more rigid adjacent and along the length of slot 28** preventing its collapse when pressure P is applied for opening the package.

To open the cover cap 23 from its closed position, the user may hold the container 12 in one hand and apply inwardly directed thumb pressure, as indicated at the arrow P. This pressure deflects the skirt wall tab inwardly in the region below slot 28 exposing an edge of the cover cap at the wall 29 for sequentially applying upward pressure by the thumb sufficient to disengage the friction lock between the bead 27*a* on the inner spout wall 19 and the exterior of the plug wall 27. If the closure utilizes a spring hinge construction, such as indicated hereinabove, the cover cap will be opened easily with the energy stored by tension of the hinge straps. Should the closure not use a spring hinge, continued pressure applied by the thumb will rotate the cap about the hinge to an open position (see FIG. 2) such that the package contents may be dispensed and used.

Referring to FIGS. 6–10, another embodiment of the invention is disclosed employing a different locking means which, if incorporated, increases the degree of child resistance of the closure. In describing this embodiment, like or similar parts are identified by the same reference numerals.

In this construction, the main closure skirt 15 is provided with a vertically extending boss comprised of parallel ribs 40 and a radial ledge 41 across the top. The ledge 41 extends radially inwardly to provide a latch surface. The skirt wall 25 of the cover cap 23 includes a radially extending hook 42 that is located along the free edge 26 of the skirt opposite hinge and adjacent ledge 41 for engagement therewith. The hook 42 has an inwardly tapered surface below the point of the hook. When the cover cap is rotated about hinge 30 to closed position, the sloped surface of hook 42 slides along the edge surface of ledge 41 by inwardly deflecting skirt wall 25 in that region. After the point of hook 42 passes the lower corner of ledge 41, the resiliency of the plastic in skirt 25 causes the point of hook 42 to extend under the ledge and be adjacent the overhang of the ledge at 41*a*. This locking means secures the cap in its closed position.

The outer periphery of the freed edge 26 of the cap 23 and the outer periphery of the shoulder 28 of the main closure are the same such that the two meet along the peripheral match line M below ledge surface 41*a* (see FIG. 9).

Figure 9:
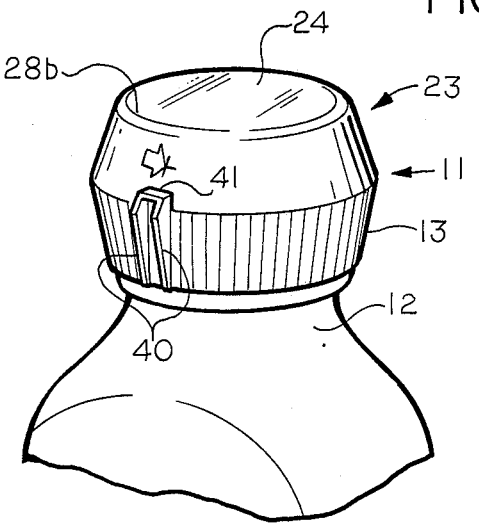
FIG. 9 is a three-quarter front prospective view of the dispensing closure of FIG. 2 showing the closure secured on a container as it appears prior to opening the package.
Figure 10:
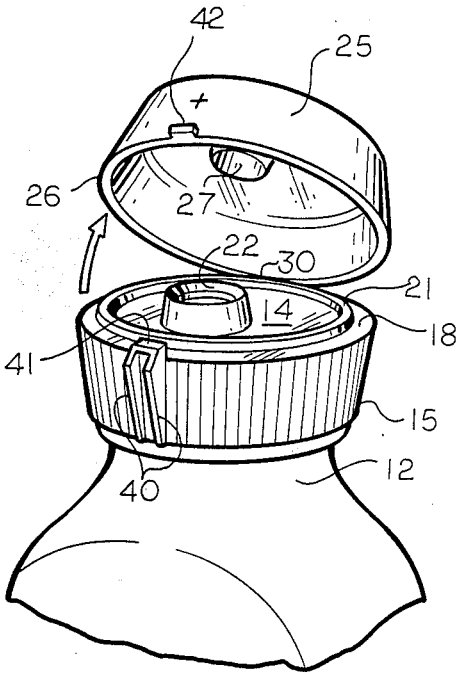
FIG. 10 is a three-quarter front prospective view like FIG. 9 in which the top cap is being pivoted to open position.

As is shown on FIG. 9, the cap 23 is opened by applying pressure P at the indicia of the arrow (labeled 1 on FIG. 9) to deflect the skirt wall inwardly enough to clear the point of hook 42 inwardly of the corner of ledge 41. This is done while holding the container in one hand and applying thumb pressure P of that hand at indicia 1. The lower edge of skirt 26 is permitted movement inwardly at that point by the clearance space outwardly of the annular wall 21. Sequentially thereafter, the thumb pressure lifts cap 23 rotating it about hinge 30, as illustrated on FIG. 10, until it assumes the open position shown on FIG. 7. When the cap 23 is rotated the other way, it closes by the resilient skirt wall 25 in the region of hook 42 deflecting inwardly until the hook point passes the ledge surface 41*a*, whereupon the hook point springs outwardly and catches under ledge 41 securing the cover cap closed.

To make the cap of this embodiment tamper evident, scoring along parallel lines located on either side of hook 42 through the lower edge 26 of the skirt (not shown in FIGS. 6–10 in a fashion similar to that disclosed in the first embodiment of the invention will enable the user to deflect the hook inwardly and break the tab portion T between the scores from the wall of the skirt, but hinged at or near the top corner radius of the skirt. Once broken out of the wall of the skirt, the tab T is released at hook 42 for opening. The breaking of the wall of the skirt in defining a section as tab T provides a visible tamper indication that shows the package has been opened.

Figure 7:
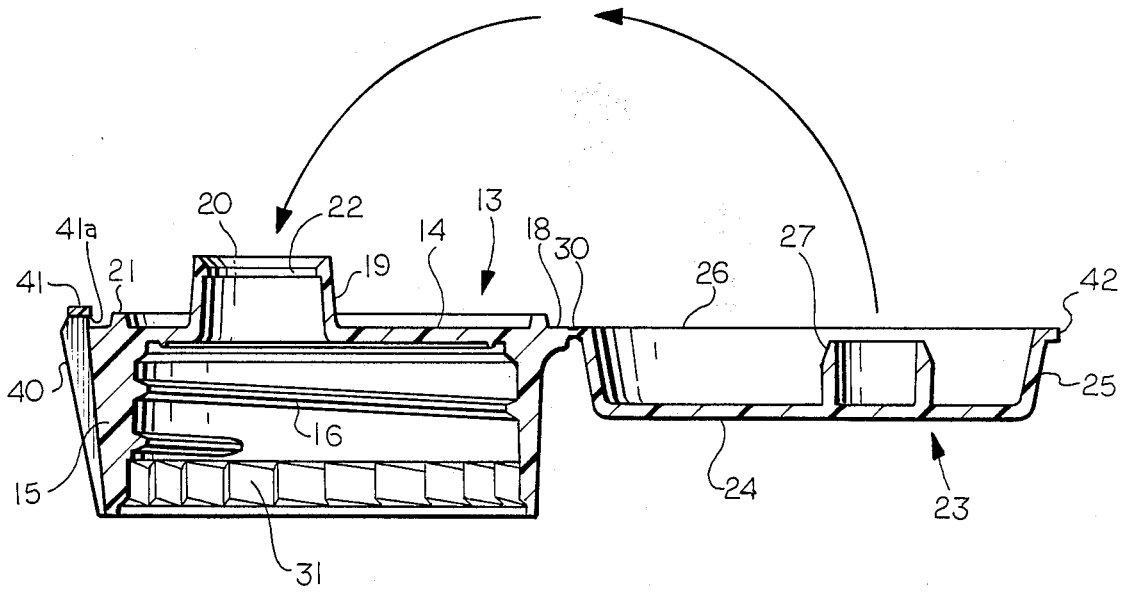
FIG. 7 is a sectional elevational view taken along line 7—7 on FIG. 6.
Figure 8:
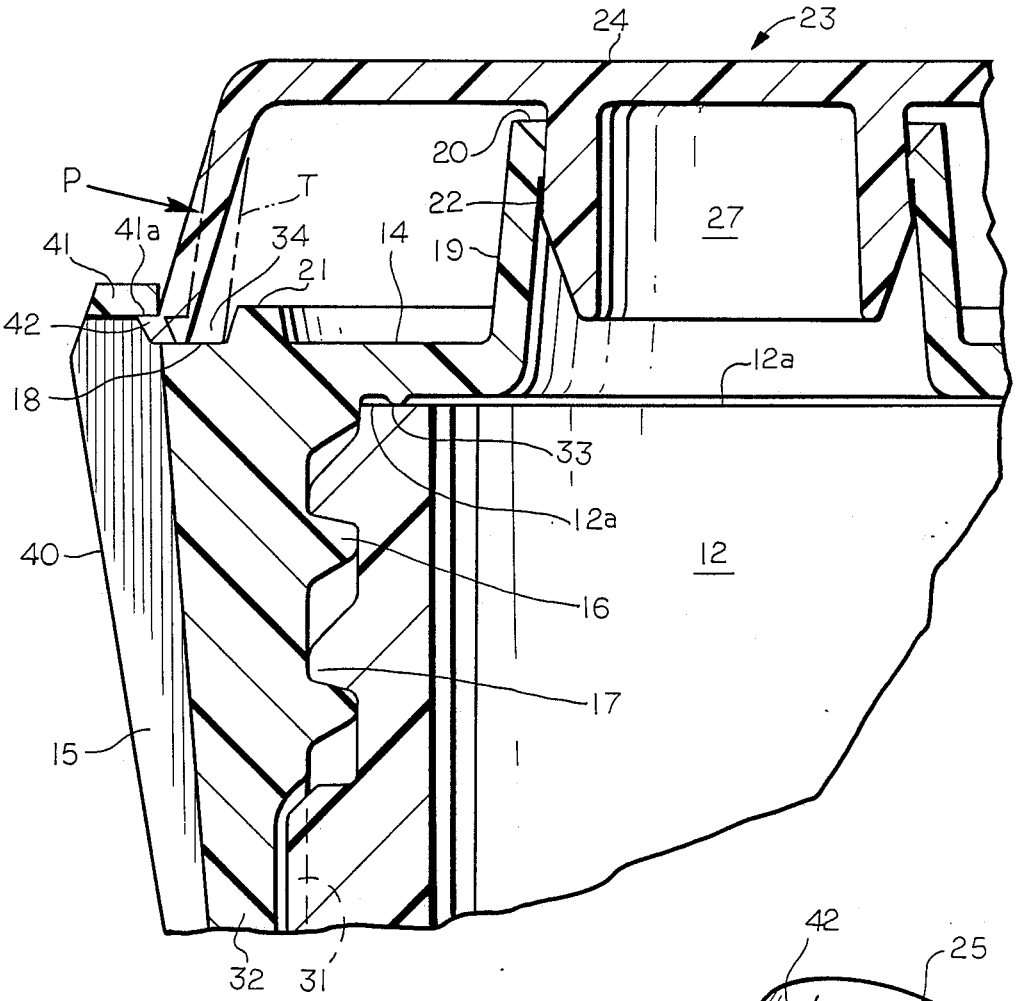
FIG. 8 is an enlarged fragmentary elevational view of the dispensing closure of FIG. 7 mounted on the neck of a container showing the cover cap in closed position.

As is shown on FIGS. 7 and 8, the same child resistant ratchet lock 31, 32 on the container is incorporated as previously described.

The preferred embodiment of the invention is illustrated and disclosed in connection with a snap hinge style of dispensing closure, however, any form of closure for adaptation to the neck of the container may utilize the invention in which a section of the skirt of the cap may be deflected to release the locking means on the closure which secured it onto the container finish.

The basic operation of the closure is designed to work in one of two modes. In the first of these, by deflecting and breaking the tab section of the skirt of the cover cap while seated on the closure, the area adjacent the narrow slot in the top wall exposes an edge for lifting the cap and releasing the internal locking means. In the second, the cover cap including a locking edge or hook at the periphery of the skirt engages a radially inwardly protruding ledge on the main closure, and the skirt wall section at the lock is deflected inwardly to release the lock. This will also allow the user to easily pry the cap open with thumb pressure.

The closure illustrated in the drawings utilizes the concepts or principles of the invention set forth in the appended claims. Those familiar with the art of manufacturing and utilizing closures will appreciate these concepts can be employed in a variety of closures which differ from the closure illustrated herein as to matters within the scope of ordinary skill in the field.

I claim:

1. A hinged dispensing closure comprising a main closure comprising a top wall and skirt, and adapted to interengage with the open neck of a container, a cover cap, said cover cap having a top wall and integral peripheral deformable skirt joined together peripherally at a radius, a hinge portion interconnecting the main closure and cover cap near their periphery for pivoting the cover cap between an open position and a closed position over the main closure, an orifice in the top of said main closure for dispensing product therethrough, the improvement therein comprising the cover cap and main closure having cooperating locking means disposed opposite said hinge portion for holding the cover cap in closed position, means in the skirt of said cover cap disposed opposite said hinge portion defining a radially inwardly deflectable tab portion which is manually deflectable for opening the cover cap, said manual deflection and opening of the cover cap being adapted for one handed opening manipulation.

2. The closure of claim 1 wherein the tab portion of said cover cap comprises a narrow slot in the top wall adjacent said radius, the tab portion when inwardly deformed exposing an edge at the slotted region for manually opening said cover cap.

3. The closure of claim 2 in which said tab portion includes axially extending lines of weakening in the skirt wall extending from said slot to the lower edge of said skirt wall, said tab portion being ruptured from said skirt by manual pressure to expose said edge at said slot.

4. The closure of claim 3 which includes a downwardly projecting wall means on the inner surface of said top wall of the cover cap located inwardly adjacent said slot, the end portion of said tab adjacent the slot being retained in an inwardly deflected position upon deflection past said wall means thereby exposing the edge of the slot in the top wall.

5. The closure of claim 3 wherein said lines of weakening extend parallel each other in the skirt wall of the cover cap and extend adjacent the lower edge of the skirt to provide thereat a hinge for pivoting the ruptured tab portion radially of the cover cap.

6. The closure of claim 3 in which said lines of weakening comprise score lines along the inner surface of the skirt wall.

7. The closure of claim 1 wherein the locking means comprises an axial spout surrounding the orifice of the main closure and an annular wall extending axially from the inner top wall of the cover cap and adapted to telescopically engage said spout to frictionally retain the two in telescopic engagement.

8. The closure of claim 7 which includes means on said spout frictionally engaging said annular wall of the cover cap to retain the cover cap closed on the main closure.

9. The closure of claim 1 which includes a second locking means comprising ratchet means on the skirt of the main closure adapted to engage the nick of the container and render the main closure child resistant against removal from the container.

10. The closure of claim 1 wherein the locking means comprises a radially outwardly extending hook member adjacent the lower edge of the tab portion of the cover cap and a latch member on the skirt wall including a radial ledge surface adjacent said hook when the cover cap is in closed position, said hook engaging said ledge to retain the cover cap in closed position, the inward deflection of said tab portion releasing the hook from engagement with the ledge.

11. The closure of claim 1 which includes an indicia on the tab portion identifying the location for applying manual pressure to inwardly deflect the tab portion.

12. A closure comprising a main closure adapted to interengage with the open neck of a container, a cover cap adapted to open and close the main closure and connected to the main closure at a peripheral hinge, said cover cap having a top wall and integral peripheral skirt joined at a radius, an orifice in the top wall of said main closure for dispensing therethrough, a slot of limited peripheral extent in the top wall of said cover cap in the region of said corner radius and disposed opposite said hinge, and locking means for holding the cover cap in closed position, the portion of said skirt wall below said slot being manually deflectable inwardly to expose an edge of said slot to release the locking means and open the cover cap by manual pressure.

13. The closure of claim 12 which includes means providing a line of weakening in said cover cap from said slot axially to the free edge of said skirt defining a tab deflectable inwardly to a position exposing the edge of said slot.

14. The closure of claim 13 which includes a stub wall projecting downwardly from the underside of said top wall of the cover cap and disposed radially inwardly adjacent said slot, the upper end of said tab upon inwardly deflection being retained by said stub wall.

15. The closure of claim 13 in which the line of weakening comprises a pair of score lines, one from each of the opposite ends of said slot extending downwardly in the skirt to a location adjacent the free edge of said skirt.

16. The closure of claim 15 wherein the score lines are parallel each other.

17. The closure of claim 15 wherein the score lines are formed along the inside surface of said skirt.

18. The closure of claim 12 which includes a second locking means adapted for holding the main closure against removal from the container, thereby rendering said closure child resistant against removal from the container.

19. A closure for a container comprising a cap having a side wall and integral top wall and adapted to be positioned over the mouth of a container, the cap being provided with cooperating locking means for holding the cap in closed position on the container, a slot molded in the wall of the cap in the proximity of said locking means enabling said wall to be deflected inwardly by pressure and expose an edge surface, whereby application of manual pressure on said edge surface opens the cap on the container.

20. The closure of claim 19 which enables opening manipulation by one hand by holding the container with said hand, and opening said cap with said hand.

21. A closure for a container comprising a cover cap having a top wall and integral skirt wall hingedly connected to a main closure along the periphery of said side wall, and said main closure is adapted to be positioned over the mouth of a container, the cover cap and main closure being provided with cooperating locking means opposite said hinge for holding the cover cap in closed position, a slot means molded in said top wall of the cover cap in the proximity of said locking means defining a tab portion of said side wall to be deflected inwardly and expose an edge surface of the top wall for rotating the cover cap about said hinge and disengaging said locking means, whereby application of manual pressure radially inwardly on said tab portion deflects said portion inwardly enabling access to said edge for opening the cover cap.

22. The closure of claim 21 which is capable of opening manipulation by one hand holding the container, and opening said top cap.

23. The closure of claim 1 which is child resistant and includes a container having a threaded neck finish defining the mouth thereof, interengaging threads on the main closure for threadingly connecting it to said neck finish, a second locking means comprising interengaging ratchets on said main closure and on said container neck finish permitting rotation of the inner cap on said neck finish in one direction and locking the inner cap against readily rotating it in the opposite direction, whereby manual access to the container is by opening the cover cap.

24. A closure for a container comprising a cover cap having a top wall and integral skirt wall, a main closure having a skirt wall and integral top wall, said cover cap skirt wall being hingedly connected to said main closure at its periphery, said main closure being adapted to be connected over the mouth of a container, said cover cap and main closure being provided with cooperating locking means opposite said hinge engageable when the cover cap is closed on the main closure, a means providing a tab portion in the skirt wall of said cover cap in the proximity of said locking means that is deflectable inwardly for lifting said cover cap and disengaging the locking means, whereby inwardly directed manual pressure on said tab portion enables opening the cover cap with one hand.

* * * * *